US009205385B2

(12) United States Patent
Sabadicci et al.

(10) Patent No.: US 9,205,385 B2
(45) Date of Patent: Dec. 8, 2015

(54) VENTURI APPARATUS WITH A FLUID FLOW REGULATOR VALVE

(75) Inventors: Rio Sabadicci, Rancho Santa Fe, CA (US); Larry D. Nelson, Carlsbad, CA (US)

(73) Assignee: Focus Products Group International, LLC, Lincolnshire, IL (US)

( * ) Notice: Subject to any disclaimer, the term of this patent is extended or adjusted under 35 U.S.C. 154(b) by 946 days.

(21) Appl. No.: 13/411,411

(22) Filed: Mar. 2, 2012

(65) Prior Publication Data

US 2012/0224451 A1 Sep. 6, 2012

Related U.S. Application Data

(60) Provisional application No. 61/449,601, filed on Mar. 4, 2011.

(51) Int. Cl.

| | |
|---|---|
| ***B01F 5/04*** | (2006.01) |
| ***B01F 3/04*** | (2006.01) |
| ***B01F 13/00*** | (2006.01) |

(52) U.S. Cl.

CPC ..... *B01F 3/0446* (2013.01); *B01F 5/0428* (2013.01); *B01F 13/002* (2013.01); *B01F 2215/0072* (2013.01)

(58) Field of Classification Search

CPC ..... B01F 2215/0072; B01F 13/002; B01F 5/0428; B01F 3/0446

USPC ..... 366/173.1, 174.1, 175.2, 181.8, 182.4, 366/182.2, 163.1, 163.2, 167.1, 176.1, 337, 366/181.5; 137/888–896

See application file for complete search history.

(56) References Cited

U.S. PATENT DOCUMENTS

| | | | | |
|---|---|---|---|---|
| 4,595,121 | A * | 6/1986 | Schultz | 222/1 |
| 5,427,151 | A * | 6/1995 | Pauley | 137/895 |
| 5,538,027 | A * | 7/1996 | Adamson et al. | 137/7 |
| 5,673,725 | A | 10/1997 | Russell et al. | |
| 7,614,614 | B2 * | 11/2009 | Sabadicci et al. | 261/76 |

(Continued)

FOREIGN PATENT DOCUMENTS

| | | | |
|---|---|---|---|
| WO | 9310890 | A1 | 6/1993 |
| WO | 2007097895 | A2 | 8/2007 |

OTHER PUBLICATIONS

International Search Report and Written Opinion for PCT/US2012/027728, mailed Sep. 24, 2012.

*Primary Examiner* — Charles Cooley
(74) *Attorney, Agent, or Firm* — Thompson Coburn LLP

(57) ABSTRACT

A Venturi apparatus includes: a body defining a receptacle chamber configured to receive a first fluid, a transition passageway in fluid communication with the receptacle chamber and configured to receive the first fluid from the receptacle chamber, a mixing chamber in fluid communication with the transition passageway and configured to receive the first fluid from the transition passageway, and a sidearm passageway in fluid communication with the mixing chamber and extending to an outer surface of the body and configured to allow a second fluid to pass from an exterior of the into the mixing chamber; and a fluid flow regulator connected to the body, configured to affect a flow of the first fluid from the receptacle chamber into the mixing chamber, and including a valve mechanism configured to selectively engage the body to inhibit flow of the first fluid from the receptacle chamber into the mixing chamber.

17 Claims, 9 Drawing Sheets

(56) References Cited

U.S. PATENT DOCUMENTS

| | | | | |
|---|---|---|---|---|
| 7,841,584 | B2 * | 11/2010 | Sabadicci et al. | 261/76 |
| 8,505,883 | B2 * | 8/2013 | Sabadicci et al. | 261/76 |
| 8,733,742 | B2 * | 5/2014 | Sabadicci et al. | 261/76 |
| 2003/0015596 | A1 | 1/2003 | Evans | |
| 2007/0187848 | A1 * | 8/2007 | Sabadicci et al. | 261/76 |
| 2009/0160072 | A1 * | 6/2009 | Chiorazzi | 261/76 |
| 2010/0072637 | A1 * | 3/2010 | Sabadicci et al. | 261/76 |
| 2011/0042835 | A1 * | 2/2011 | Sabadicci et al. | 261/76 |
| 2012/0224451 | A1 * | 9/2012 | Sabadicci et al. | 366/163.2 |
| 2012/0314529 | A1 * | 12/2012 | Sabadicci et al. | 366/163.2 |
| 2014/0232020 | A1 * | 8/2014 | Sabadicci et al. | 261/76 |

* cited by examiner

VENTURI APPARATUS WITH A FLUID FLOW REGULATOR VALVE

CROSS-REFERENCES TO RELATED APPLICATIONS

This application claims benefit of priority from U.S. Provisional Patent Application No. 61/449,601, filed Mar. 4, 2011, entitled "VENTURI APPARATUS."

BACKGROUND

Venturi-type devices typically comprise fittings or tubular structures, and in particular pipe structures, that are constricted in the middle and flared on both ends. When a fluid, such as a gas or liquid, is passed through the Venturi device, the fluid's velocity increases whereas the fluid's pressure correspondingly decreases. Such devices are used in a variety of applications, including measuring fluid flow or for creating suction as for driving aircraft instruments or drawing fuel into the flow stream of a carburetor.

One application of a Venturi device is for mixing or combining of a second fluid with a first fluid passing through the Venturi device. For instance, a Venturi device known as a Vinturi® may be used for aeration of a liquid, such as wine. The Vinturi accepts the liquid to be aerated at an upper receptacle portion. The liquid flows downward through the receptacle portion of the with the aid of gravity into an intermediate mixing chamber, into which air is introduced via sidearm passageways. The cross-sectional area of the mixing chamber in relation to the cross-sectional area of the bottom of the receptacle chamber creates a pressure differential between the mixing chamber and the atmosphere outside the Vinturi. This pressure differential causes the air to be introduced into the mixing chamber and mix into the liquid flowing through the mixing chamber. The resulting mixture of liquid and air exits through a bottom of the intermediate mixing chamber via gravity into an exit chamber, from which the mixture exits the Vinturi.

SUMMARY

An example of a Venturi apparatus for facilitating the mixture of two or more fluids according to the disclosure includes a body defining a receptacle chamber configured to receive a first fluid, a transition passageway disposed below and in fluid communication with the receptacle chamber and configured to receive the first fluid from the receptacle chamber, a mixing chamber disposed below and in fluid communication with the transition passageway and configured to receive the first fluid from the transition passageway, and a sidearm passageway in fluid communication with the mixing chamber and extending to an outer surface of the body and configured to allow at least a second fluid to pass from an exterior of the body through the sidearm passageway into the mixing chamber. A top cross-sectional area of the mixing chamber is greater than a bottom cross-sectional area of the first passageway. The Venturi apparatus further includes a fluid flow regulator connected to the body and configured to affect a flow of the first fluid from the receptacle chamber into the mixing chamber. The fluid flow regulator includes a valve mechanism configured to selectively engage the body to inhibit flow of the first fluid from the receptacle chamber into the mixing chamber.

Implementations of the Venturi apparatus may include one or more of the following features. The receptacle chamber, the first passageway and the mixing chamber are configured to pass the first fluid therethrough with the receptacle chamber, the first passageway and the mixing chamber disposed in vertical alignment and the first fluid subjected to gravity. The valve mechanism includes a plunger housing fixedly mounted to the body and a plunger slidably coupled with the plunger housing, and the plunger housing defines a path of movement of the plunger. The plunger housing includes a guide portion and a retainer portion connected to and disposed above the guide portion. The retainer includes a plurality of horizontal prongs which extend over the plunger to restrict vertical travel of the plunger as the plunger moves along the path of movement. The plunger is positionable within the plunger housing in a closed position, in which the plunger engages at least a portion of a wall of the transition passageway to substantially obstruct fluid flow through the first passageway and into the mixing chamber, and an open position, in which the plunger is displaced from the wall of the transition passageway to permit flow of the first fluid through the first passageway and into the mixing chamber. The plunger includes a plunger tip providing a bottom surface of the plunger and having a shape corresponding to the at least a portion of the wall of the transition passageway and a cross sectional area greater than a cross sectional area of the at least a portion of the transition passageway.

Implementations of the Venturi apparatus may additionally or alternatively include one or more of the following features. The fluid flow regulator further includes an actuator that is physically separated from the plunger and is configured to actuate the plunger to slide relative to the plunger housing. The plunger includes a first magnet, and the actuator includes a second magnet rotatably coupled to the body. The actuator further includes an actuator member movably coupled to the body and configured to cause, when moved relative to the body, the second magnet to rotate from a first orientation biasing the plunger into a closed position to a second orientation biasing the plunger into an open position. The actuator further includes an actuator housing and a magnet housing containing the second magnet, the actuator member is movably coupled to the actuator housing and includes a plurality of arms disposed along a bottom portion of the actuator member and slidably coupled to an interior of the actuator housing, the actuator member is positionable relative to the actuator housing in an actuated position and an unactuated position, and the magnet housing is pivotably coupled to the actuator housing by a plurality of pivot pins extending from opposing sides of the magnet housing. Each of the plurality of pivot pins includes cogs having first teeth disposed along at least a portion of the circumference of the pin, and each of the plurality of arms includes second teeth that are sized, shaped and disposed corresponding to the first teeth such that the first teeth mesh with the second teeth. The second teeth of the arms are configured to interact with the first teeth of the pivot pins to rotate the pivot pins when the actuator member moves between the unactuated position and the actuated position, thereby rotating the second magnet between the first orientation when the actuator member is in the unactuated position and the second orientation when the actuator member is in the actuated position. In the first orientation, the second magnet has a first pole closer to the plunger than a second pole, and in the second orientation has the second pole closer to the plunger than the first pole, the first pole having a magnetic polarity opposite to a magnetic polarity of a bottom pole of the first magnet. The first teeth and second teeth are configured and the actuator member has sufficient travel relative to the pivot pins such that movement of the actuator member causes rotation of the second magnet between the first orientation and the second orientation. The actuator further includes a return spring configured and disposed to bias the actuator member into the unactuated position.

Still other implementations of the Venturi apparatus may include one or more of the following features. The fluid flow regulator includes a valve mechanism and an actuator that is physically separate from the valve mechanism and is configured to actuate the valve mechanism contactlessly, without direct physical contact between the actuator and the valve mechanism. The sidearm passageway is a first sidearm passageway, the body further defining a second sidearm passageway, the first and second sidearm passageways being disposed within the body aligned along a common plane and fluidly connected to a median of the mixing chamber, and each of the plurality of sidearm passageways includes an outer opening that is open to the atmosphere and permits entry of atmospheric gases and an inner opening that opens into the mixing chamber. The receptacle chamber is open to the atmosphere. The body further defines an exit chamber disposed below and in fluid communication with the mixing chamber and configured to receive a mixture of the first fluid and the second fluid from the mixing chamber, and a bottom cross-sectional area of the mixing chamber is greater than a top cross-sectional area of the exit chamber.

An example of a method of aerating a liquid according to the disclosure includes disposing a Venturi apparatus above a receiving container, pouring the liquid into an entrance portion of the Venturi apparatus, inhibiting flow of the liquid from the entrance portion into a mixing chamber fluidly connected to the entrance portion, actuating an actuator housed at least partially within the Venturi apparatus to selectively uninhibit the flow of the liquid from the entrance portion to the mixing chamber and permit mixture within the mixing chamber between the liquid and atmospheric gases, thereby obtaining aerated liquid, and receiving the aerated liquid from an exit chamber of the Venturi apparatus via the receiving container.

Implementations of the method may include one or more of the following features. The pouring includes pouring the liquid into the entrance portion of the Venturi apparatus while the Venturi apparatus is situated substantially vertically, thereby permitting the liquid to flow through the Venturi apparatus due to gravity. The inhibiting includes substantially obstructing the flow of the liquid from the entrance portion into the mixing chamber. The inhibiting further includes magnetically biasing a plunger into contact with a body of the Venturi apparatus. The actuating includes magnetically biasing the plunger away from contact with the body. The liquid includes at least one of wine or a spirit. The disposing includes disposing the Venturi apparatus above the receiving container such that the entrance portion of the Venturi apparatus is open to the atmosphere. The disposing includes fluidly connecting the entrance portion of the Venturi apparatus to a container holding the liquid.

An example of a Venturi apparatus for facilitating the mixture of a liquid with a gas according to the disclosure includes a body defining a receptacle chamber configured to receive the liquid, a mixing chamber disposed below and in fluid communication with the receptacle chamber and configured to receive the liquid, and a sidearm passageway in fluid communication with the mixing chamber and extending to an outer surface of the body, and configured to allow the gas to pass from an exterior of the body adjacent to the outer surface into the mixing chamber. The Venturi apparatus further includes flow regulating means for selectively inhibiting flow of the liquid from the receptacle chamber to the mixing chamber and for selectively permitting flow of the liquid from the receptacle chamber to the mixing chamber, the flow regulating means comprising valve means and actuating means for actuating the valve means, without physical contact with the valve means, to selectively inhibit or selectively permit flow of the liquid from the receptacle chamber to the mixing chamber.

Implementations of the Venturi apparatus may include one or more of the following features. The actuating means includes a first magnet coupled to the valve means and a second magnet coupled to an actuating member movably coupled to the body.

BRIEF DESCRIPTION OF THE DRAWINGS

Features and advantages of the various embodiments disclosed herein will be better understood with respect to the following description and drawings.

DETAILED DESCRIPTION

Various examples of Venturi apparatus are described herein. For example, a Venturi apparatus is structured to utilize the Venturi effect to facilitate the mixture of fluids, such as a liquid and a gas. The Venturi apparatus can mix air with an alcoholic liquid such as hard liquor (spirits) or wine, though other liquids and/or gasses could be used.

An example Venturi apparatus comprises multiple sections that combine to define a fluid passageway that selectively allows a fluid to pass through the apparatus downwardly when the apparatus is oriented substantially vertically. A receptacle section comprises a generally funnel-type chamber for receiving a first fluid. The receptacle section channels the first fluid through a first passageway into a mixing chamber, where a second fluid is mixed with the first fluid. The resulting fluid mixture then flows from the mixing chamber into an exit chamber from which the mixture exits the Venturi apparatus.

A valve mechanism is positioned within the receptacle section and comprises a plunger that regulates the flow of the first fluid through the receptacle section and the first passageway. The plunger is positionable via an actuator in a first, closed position to engage the first passageway to obstruct the flow of the first fluid and in a second, open position to provide little if any resistance to such flow. The actuator is magnetically coupled to the valve mechanism and controls the position of the plunger by manipulating the orientation of a magnet housed within the actuator relative to that of a magnet housed within the plunger.

Figure 1:
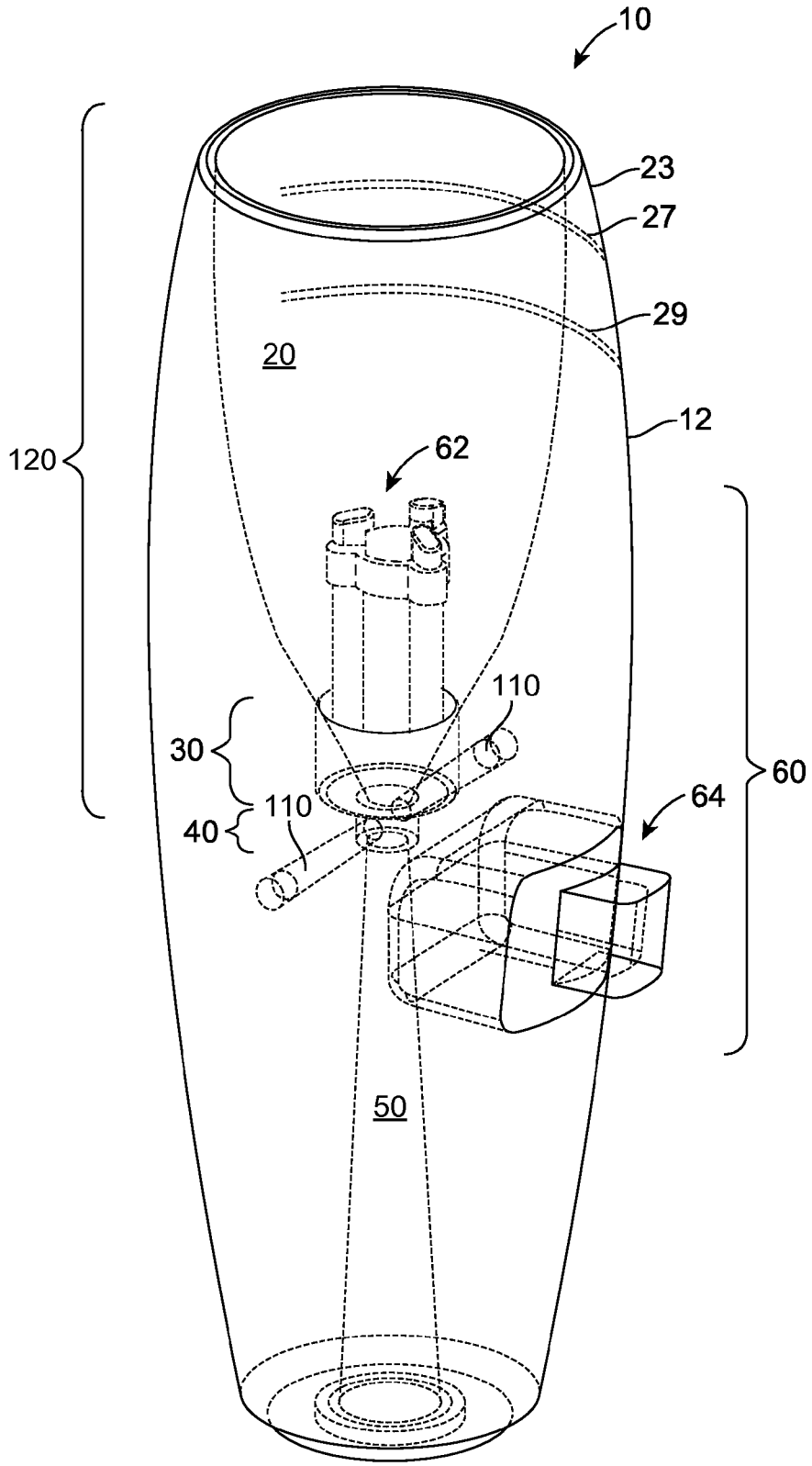
FIG. 1 is an elevated perspective view of a housing incorporating an improved Venturi apparatus.

Referring to FIG. 1, there is perspectively illustrated an improved Venturi apparatus 10 that is operative to facilitate the mixture of two or more fluids. The term "fluid" as used herein can comprise any fluid-type substance and includes any type of liquid or gas, as well as materials caused to assume either a liquid or gaseous state as may be caused by the application of either heat and/or pressure, and thus includes condensates and vaporized or melted materials. By way of example, and not limitation, a fluid as referred to herein includes air, water, alcoholic beverages such as wine and/or spirits, etc.

The improved Venturi apparatus 10 comprises a body 12 that includes or defines several sections or portions, namely, a receptacle chamber 20, transition passageway 30, a mixing chamber 40, two sidearm passageways 110, an exit chamber 50, and a fluid flow regulator 60, all of which are discussed more fully below. The sections 20, 30, 40, 50 are in fluid communication with each other and configured to direct at least one first fluid to flow through the receptacle chamber 20, the transition passageway 30, the mixing chamber 40, and the exit chamber 50 and to cause at least one second fluid, via the passageways 110, to be drawn into the mixing chamber 40. The first and second fluids are combined in the mixing chamber 40 and exit the apparatus 10 via the exit chamber 50. The fluid flow regulator 60 regulates flow of the first fluid from the receptacle chamber 20 into the transition passageway 30 and beyond. The apparatus 10 is configured to be disposed substantially vertically in operation, with the receptacle 20 above the transition passageway 30, the transition passageway 30 above the mixing chamber 40, and the mixing chamber 40 above the exit passageway 50, such that a first fluid introduced (e.g., a liquid poured) into the receptacle chamber 20 under forces of atmospheric pressure and gravity alone will flow from the receptacle chamber 20 into the transition passageway 30, the mixing chamber 40, and the exit chamber 50, when the fluid flow regulator 60 permits, with sufficient speed to induce a second fluid (e.g., a gas such as air) from outside the apparatus 10 to flow through the sidearm passageways 110 into the mixing chamber 40 and mix with the first fluid.

Figure 2:
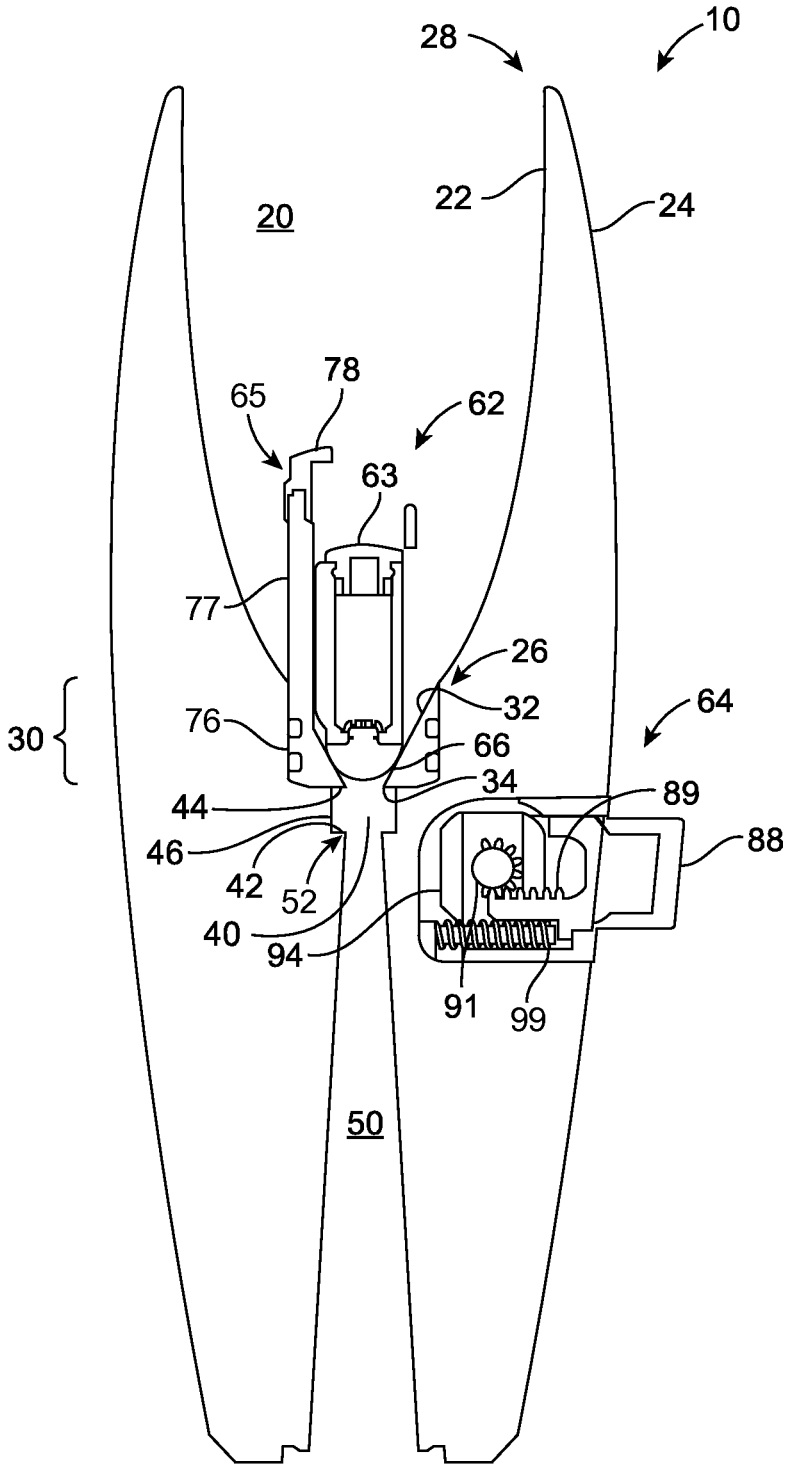
FIG. 2 is a cross-sectional view of the apparatus shown in FIG. 1 in a closed position.

Referring also to FIG. 2, the receptacle chamber 20 is a generally funnel-type chamber defined by an interior wall 22 of a receptacle portion 24. The chamber 20 provides an opening for receiving a first fluid. The first fluid may comprise either a single fluid or a mixture of fluids. The term "funnel-type" as used herein refers to any uniform or non-uniform, regular or irregular chamber structure possessing a tapered configuration with a cross-sectional area at a bottom end 26 that is smaller than a cross-sectional area at a top end 28 of the chamber 20. Preferably, the chamber 20 has a progressively decreasing cross-sectional area. Here, the chamber 20 has a truncated ovate shape. Other shapes, however, may be used such as frusto-conical, polyhedral, truncated obovate, semi-spherical, etc. The receptacle section 20 is configured to cause acceleration of the first fluid through the receptacle section 20 with the first fluid subject to atmospheric pressure and gravity. Here, the chamber 20 is open to the atmosphere; however, the chamber 20 may alternatively be structured such that it is in direct fluid communication with an external body, such as a bottle containing the first fluid.

The receptacle section 20 is configured to channel the first fluid to the transition passageway 30 that is disposed below and fluidly coupled to the receptacle section 20. The transition passageway 30 is defined by a smooth, rounded surface 32 and is operative to normalize fluid flow and thus reduce fluid turbulence. Here, the transition passageway 30 has a frusto-conical structure; however, the transition passageway 30 can alternatively have a regular or irregular, tapered or non-tapered structure, such as a cylindrical structure. Together, the receptacle section 20 and the transition passageway 30 collectively form an entrance section 120 from which the first fluid flows into the mixing chamber 40.

The mixing chamber 40 is disposed below the transition passageway 30. As illustrated, the mixing chamber 40 is provided with a generally planar floor 42 and a generally planar ceiling 44 as well as a midsection 46 having a cross-sectional area that is greater than a cross-sectional area of a bottom 34 of the transition passageway 30. There is an abrupt transition in cross-sectional area from the transition passageway 30 to the mixing chamber 40. The mixing chamber 40 is configured such that the first fluid passing from the transition passageway 30 to the mixing chamber 40 will induce a pressure differential between the mixing chamber and the atmosphere outside the apparatus 10. This pressure differential will create a vacuum force that causes a second fluid to be drawn into the mixing chamber 40 through the sidearm passageways 110 as shown.

The exit chamber 50 facilitates the mixture between the fluids and directs the mixture to the bottom of the apparatus 10 to exit the apparatus 10 and be received by an appropriate receptacle, such as a glass (e.g., wine glass, shot glass, tumbler, etc.). Similar to the receptacle chamber 20, the exit chamber 50 can be constructed using any suitable uniform or non-uniform structure or combination of structures. Here, the exit chamber 50 comprises a tapered frusto-conical structure with a widening cross-sectional area. Alternatively, the exit chamber 50 can be cylindrical, semi-ovate, polyhedral, etc. Preferably, as here, a cross-sectional area of a top 52 of the exit chamber 50 is less than a bottom cross-sectional area of the mixing chamber 40, i.e., a cross-sectional area of the floor 42 of the mixing chamber 40. This variance in cross-sectional area contributes to the mixture of fluids within the apparatus 10 by causing a change in relative pressure as the available volume expands while additionally extending the contact time between the mixed fluids within the exit chamber 50 as the liquids pass therethrough. The structure of the exit chamber 50 additionally affects the velocity of the fluids passing through the apparatus 10, including the exit chamber 50 in addition to sections 20, 30, and 40.

An exterior wall 23 of the receptacle portion 24 includes markings 27, 29 provided along the surface of the Venturi apparatus 10, although these markings 27, 29 are optional. The markings 27, 29 indicate standardized measurements (e.g., in fluid ounces or fractions of fluid ounces) of the first fluid within the receptacle chamber 20. Here, the lower marking 27 indicates a portion of the receptacle chamber 20 having a capacity of one fluid ounce and the upper marking 29 indicates a portion of the receptacle chamber 20 having a capacity of one and a half fluid ounces. Other or additional markings could also be used. Additionally, a total fluid capacity of the receptacle chamber 20 can also correspond to a standard measurement. Here, the fluid capacity from the bottom 26 to the top 28 of the receptacle chamber 20 is two ounces. Other sizes could also be utilized.

The fluid flow regulator 60 includes a valve mechanism 62 positioned within the receptacle portion 20 and an actuator 64 at least partially housed within the apparatus 10. The valve mechanism 62 is controlled via the actuator 64 to regulate flow of the first fluid through the receptacle portion 20, the transition passageway 30 and the mixing chamber 40. The actuator 64 is contactless relative to the valve mechanism 62, such that the actuator 64 is not in direct physical contact with the valve mechanism 62.

Figure 4:
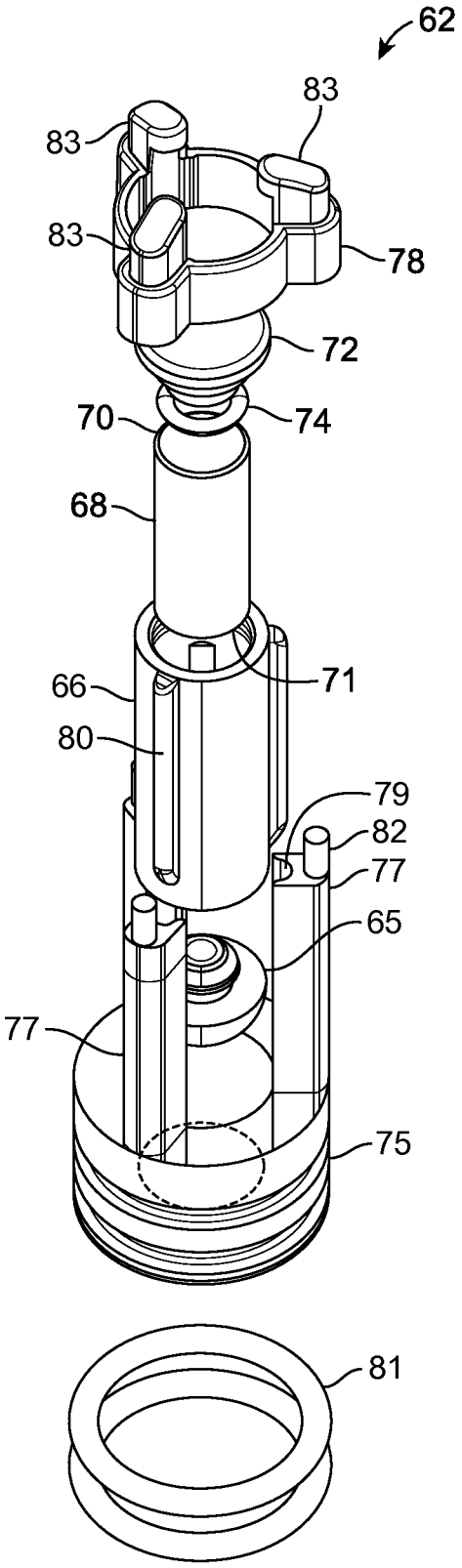
FIG. 4 is an exploded view of a valve mechanism of the apparatus shown in FIG. 1.

The valve mechanism 62 comprises a plunger 63 that is slidably coupled with a plunger housing 65 that is fixedly mounted within the apparatus 10 to the receptacle wall 24. Referring also to FIG. 4, the plunger 63 includes a generally tubular magnet housing 66 and a tip 67 fastened to a bottom end of the magnet housing 66. The plunger tip 67 has a shape corresponding to (to mate with or match) a shape of the transition passageway 30. Here, the plunger tip 67 is domed; however, the plunger tip 67 could be any other shape or combination of shapes, e.g., cylindrical, frusto-conical, rounded conical, partially obovate, etc., such that the plunger tip 66 corresponds to the shape of the transition passageway 30. Further a cross-sectional area of some part of the plunger tip 67 is larger than a cross-sectional area of some part of the transition passageway 30, thereby causing the plunger 63 via the plunger tip 67 to interfere with and contact a wall of the passageway 30 to inhibit, and preferably prevent, the passage of the first fluid through the transition passageway 30 when the plunger 63 is in a closed position, as described below. The plunger tip 67 is composed of a substantially rigid material that is shaped to correspond to the shape of the transition passageway 30 and sufficiently weighted to provide a substantially fluid-tight seal between the transition passageway 30 and the mixing chamber 40 when the plunger tip 67 is received within the body 12 of the apparatus 10, e.g., at the transition passageway 30. Here, stainless steel is disposed within an interior of the plunger tip 67 to increase the weight of the plunger 63 and improve the sealing performance of the valve mechanism 62. Other materials could also be utilized. As an alternative to a rigidly constructed plunger tip 67, the plunger tip 67 may also be composed of a flexible material such that the shape of the plunger tip 67 at least partially conforms to the shape of the transition passageway 30 when closed.

The plunger 63 includes a magnet 68 positioned within the magnet housing 66. The magnet 68 is disposed above the plunger tip 67 and is fixedly connected (e.g., glued or otherwise held in a fixed position) within the magnet housing 66. The magnet has a first pole 70, here its south pole, disposed opposite to the plunger tip 67 and a second pole 71, here its north pole, disposed adjacent to the tip 67. The magnet 68 is a rare earth magnet or other suitably manufactured magnetic object. To prevent contact between the magnet 68 and fluids flowing through the apparatus 10, the magnet is nickel plated and/or otherwise coated, e.g., with a substantially magnetically inert material. Here, the shape of the magnet 68 substantially matches that of the magnet housing 66. However, the magnet 68 may be of any shape (e.g., conical or frusto-conical, polyhedral, etc.), provided it is at least partially positionable within the magnet housing 65 and the shape of the magnet 68 defines a magnetic field that enables the fluid flow regulator 60 to operate in a predictable and controlled manner.

A cap 72 is fastened to a top end of the magnet housing 66 and, together with the magnet housing 66 and the plunger tip 67, fully enclose the magnet 68 such that the magnet 68 does not directly contact the first fluid flowing through the apparatus 10. To restrain the position of the magnet 68 within the magnet housing 66 and to facilitate the connection between the magnet housing 66 and the cap 72, one or more O-rings 74 are disposed between the cap 72 and the magnet 68. While not shown in FIG. 4, one or more O-rings may also be disposed between the magnet 68 and the plunger tip 67.

Figure 3:
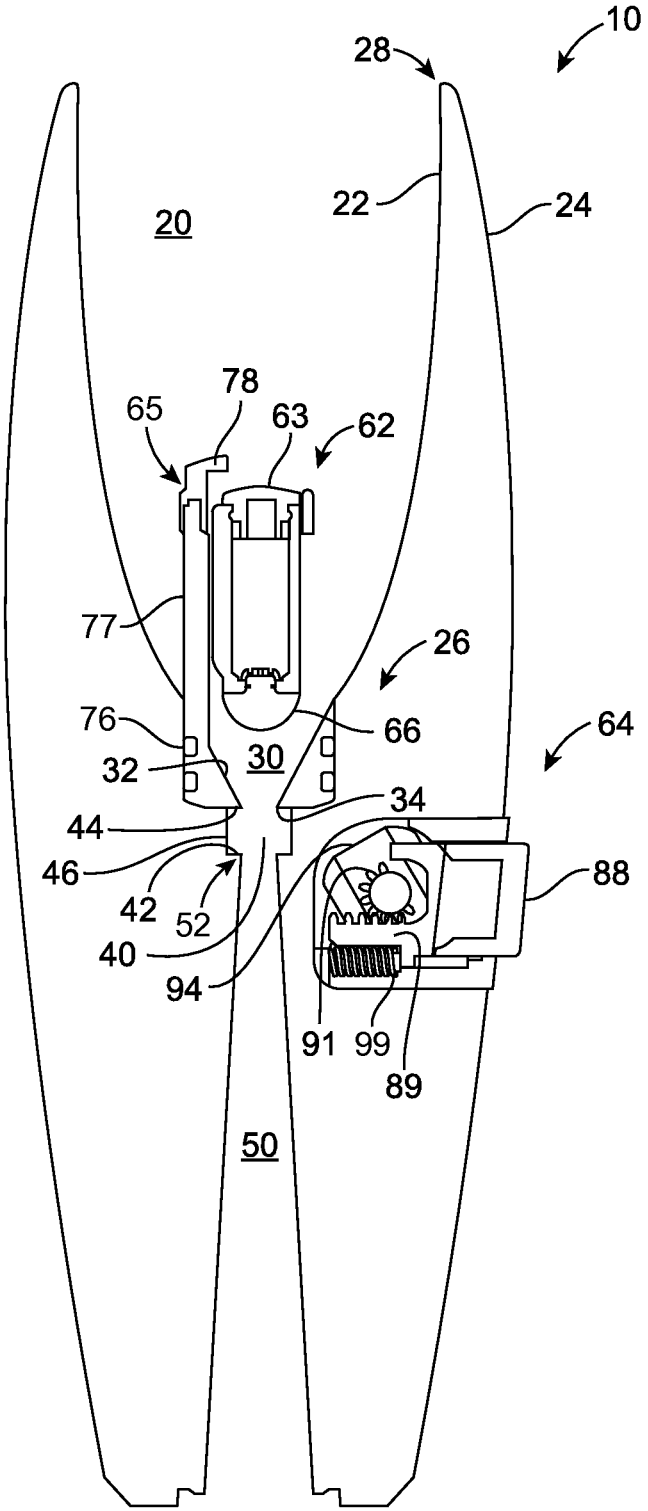
FIG. 3 is a cross-sectional view of the apparatus shown in FIG. 1 in an open position.

A path of movement of the magnet housing 66 within the valve mechanism 62 is defined via the plunger housing 65. The plunger housing 65 comprises a lower guide portion 75, an upper guide portion 76 fixably connected to and disposed above the lower guide portion 75, and a retainer portion 78 fixably connected to and disposed above the upper guide portion 76. For purposes of illustration, FIGS. 2 and 3 show partial cut-away views of the plunger housing 65 that illustrate the plunger housing 65 on the left side and the transition passageway 30 on the right side. However, as shown in FIG. 4, the plunger housing 65 is configured to receive the plunger 63 at regular angles substantially surrounding a perimeter of the plunger 63.

The lower guide portion 76 is a substantially outwardly cylindrical structure that is fixably situated within the apparatus 10, e.g., at the time of manufacture. The lower guide portion 76 comprises an inner opening through which the transition passageway 30 is defined. One or more O-rings 81 are disposed above and/or below the lower guide portion 76. The upper guide portion 76 comprises a plurality of elongated members 77. Here, the upper guide portion 76 has three members 77, though other quantities of the members 77 are possible. The members 77 of the upper guide portion 76 are inset with grooves 79 that mesh with respective raised strips 80 positioned along the perimeter of the magnet housing 66, thereby slidably coupling the magnet housing 66 to the upper guide portion 76. The retainer portion 78 fastens to the upper guide portion 76 via tabs 82 positioned at the top of each elongated member of the upper guide portion 76. The retainer portion 78 comprises horizontal prongs 83 corresponding to the elongated members 77 of the upper guide portion 76, which extend over the plunger 63 to restrict vertical travel (i.e., define a maximum vertical displacement) of the plunger 63 as it moves about the upper guide portion 76.

The lower guide portion 76, along with the upper guide portion 76 and the retainer, collectively define a laterally restricted range of motion of the plunger 63. More particularly, interference between the tip 67 of the plunger 63 and the lower guide portion 76 defines a lower vertical displacement or position of the plunger 63, while interference between the retainer 78 and the cap 72 of the plunger 63 defines an upper vertical displacement or position.

The plunger 63 is positionable in a first, closed position, shown in FIG. 2, to engage a wall of the transition passageway 30 to substantially obstruct fluid flow through the transition passageway 30 and into the mixing chamber 40. As used herein, "substantially obstruct" refers to an obstruction of at least approximately 90 percent of the fluid flow between the entrance section 120 to the mixing chamber 40, and more preferably at least approximately one of 91 percent, 92 percent, 93 percent, 94 percent, 95 percent, 96 percent, 97 percent, 98 percent, or 99 percent, and even more preferably approximately 100 percent. The plunger 63 is also positionable in a second, open position, shown in FIG. 3, to permit flow of the first fluid into the transition passageway 30 with little if any resistance to such flow by the plunger 63 such that a flow of the first fluid through the apparatus 10 with the plunger 63 in the open position will cause the second fluid to be mixed with the first fluid in the mixing chamber 40. Other configurations of the valve mechanism 62, e.g., corresponding to intermediate positions of the plunger 63, can also be used to provide varying fluid flow amounts. As described above, movement of the plunger 63 within the receptacle section 20 and the transition passageway 30 is restricted laterally by the plunger housing 65.

Figure 5:
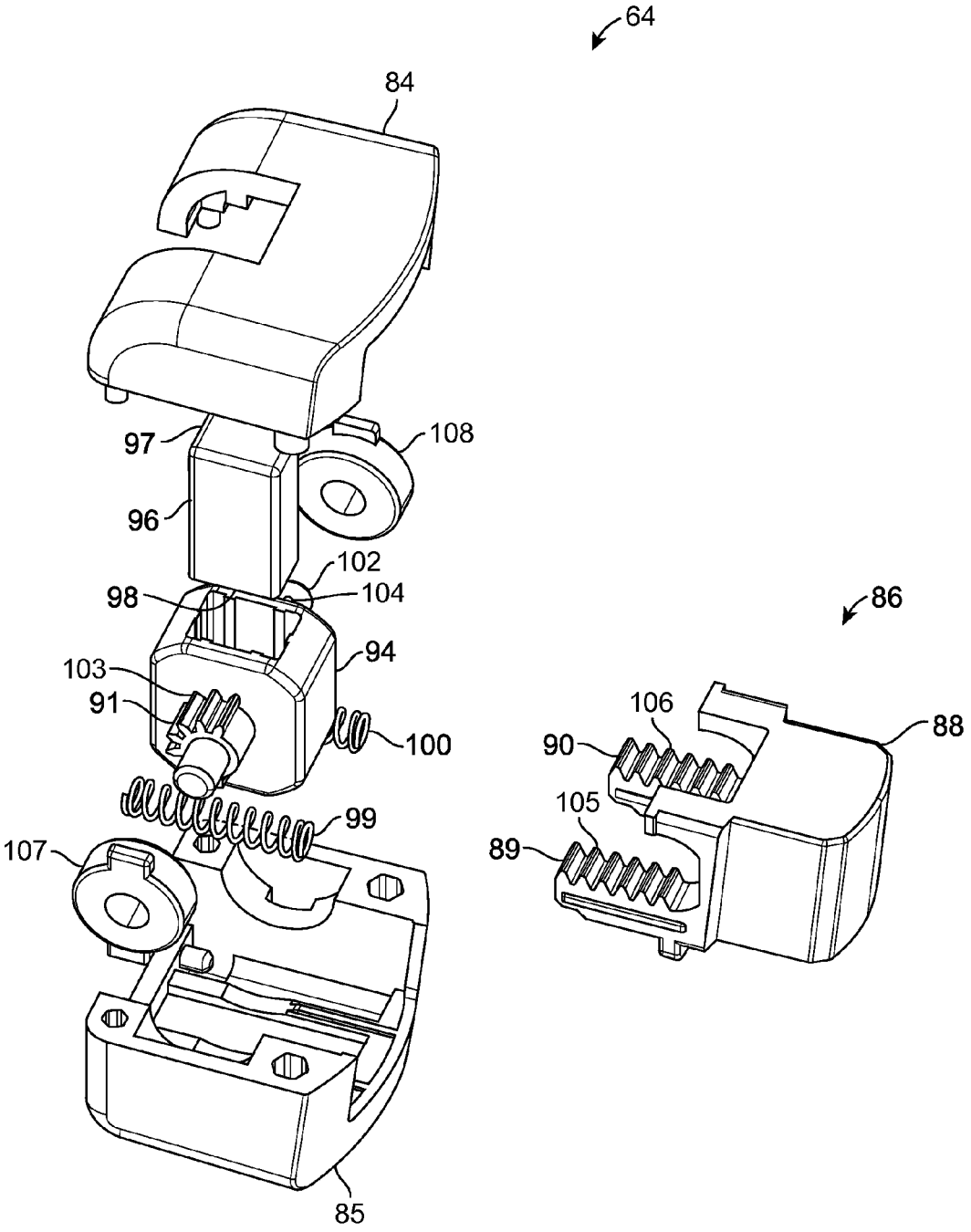
FIG. 5 is an exploded view of an actuator mechanism of the apparatus shown in FIG. 1.

The actuator 64 is configured to magnetically actuate the plunger 63 to move the plunger 63 between the closed position and the open position. Here, the actuator 64 is configured to actuate the plunger 63 contactlessly, without direct physical contact between the actuator 64 and the plunger 63 or any other portion of the valve mechanism 62. Referring to FIG. 5, the actuator 64 includes an upper housing 84 and a lower housing 85. The upper housing 84 and lower housing 85 collectively enclose at least some of the components of the actuator 64 described below and are fixably positioned within the apparatus 10 such that a front-facing edge of the upper housing 84 and lower housing 85 substantially align with the body 12 of the apparatus 10. The actuator 64 is isolated from the fluids flowing through the apparatus 10. In particular, the apparatus 64 is physically separated from the sidearm passageways 110, the receptacle chamber 20, the transition passageway 30, the mixing chamber 40 and the exit chamber 50 such that the actuator 64 is not in fluid communication with any of these sections 20, 30, 40, 50, 110. A magnet housing 94 is disposed between the upper housing 84 and lower housing 85. The magnet housing 94 comprises an opening configured to receive a magnet 96, which is fixably enclosed within the magnet housing 94. The magnet housing 94 is rotatably coupled to the upper housing 84 and lower housing 85 by pivot pins 91, 92. The pivot pins 91, 92 are cogs with at least a portion of their circumferences having teeth 103, 104. The magnet 96 is, e.g., a rare earth magnet or another suitably manufactured object that exhibits magnetic properties. The magnet 96 is positioned within the magnet housing 94 such that a first pole, here its south pole 97, is disposed proximate to the upper housing 84 and a second pole, here its north pole 98, is disposed proximate to the lower housing 85. Bearings 107, 108 are disposed along either side of the magnet housing 94 to hold the magnet housing 94 in place within the upper housing 84 and lower housing 85.

An actuator rack or actuator member 86 is additionally partially housed within the upper housing 84 and lower housing 85. The actuator rack 86 comprises a pushbutton 88 that extends from the upper housing 84, lower housing 85, and body 12 of the apparatus 10. The actuator rack 86 includes two arms 89, 90 having teeth 105, 106 configured (e.g., sized, shaped and displaced) corresponding to the teeth 103, 104 of the pivot pins 91, 92 such that the teeth 105, 106 of the arms 89, 90 on each side of the actuator rack 86 mesh with the teeth 103, 104 of the pivot pins 91, 92 on the corresponding sides. While FIG. 5 illustrates an actuator 64 having two pivot pins 91, 92 having teeth 103, 104 and two arms 89, 90 having teeth 105, 106, the actuator 64 could instead use one pivot pin and one corresponding arm, and the pivot pin may be internal to the housing 94 instead of extending outwardly from the housing 94. Still other numbers and/or configurations of pivot pins and/or arms are possible. The arms 89, 90 extend from the pushbutton 88 along a bottom portion of the actuator rack 86 that is slidably received by the lower housing 85.

The teeth 105, 106 of the arms 89, 90 are configured to interact with the teeth 103, 104 on the corresponding pivot pins 91, 92 to rotate the pivot pins 91, 92 when the pushbutton 88 slides within the body 12 to cause the magnet housing 94 to rotate between a first orientation (FIG. 2) and a second orientation (FIG. 3). The magnet housing 94 is rotated to the first orientation when the pushbutton 88 is in a default, unactuated position, and is rotated to the second orientation when the pushbutton 88 is in an actuated position.

The magnet 96 is disposed in the magnet housing 94 such that a pole 97 that is proximate to the plunger tip 67 while the magnet housing 94 is in the first orientation is the same as the pole 71 that is adjacent to the plunger tip 67. In other words, as shown in FIG. 2, the first orientation of the magnet housing 94 has a magnetic polarity of a bottom-facing pole 71 of the magnet 68 of the valve mechanism 62 opposite to a magnetic polarity of a pole 97 of the magnet 96 of the actuator 64 proximate to the magnet 68, thereby resulting in a net attractive force between the magnets 68, 96 and causing the plunger tip 67 of the valve mechanism 62 to be biased toward and positioned in the first, closed position. The teeth 103, 104, 105, 106 are configured and the actuator member 86 has sufficient travel such that movement of the actuator member 86 will cause sufficient rotation of the magnet housing 94 to rotate a pole 98, that is identical in polarity to the pole 71, to become proximate to the plunger tip 67 compared to the pole 97 (i.e., the pole 98 is closer to the pole 71 than the pole 97 is to the pole 71). In other words, as shown in FIG. 3, the second orientation of the magnet housing 94 is rotated approximately 135 degrees relative to the first orientation, e.g., between about 125 and 145 degrees, or between about 115 and 155 degrees. Other amounts of rotation could be used, e.g., about 180 degrees. The amount of rotation of the magnet housing is chosen to cause the magnetic polarity of the bottom-facing pole 71 of the magnet 68 to match the magnetic polarity of the pole 98 of the second magnet 96 proximate to the magnet 68, thereby resulting in a net repulsive force between the magnets 68, 96 and to cause the plunger tip 67 of the valve mechanism 62 to be biased toward and positioned in the second, open position. Here, a straight arrow pointing from a center of the pole 98 through a pivot axis of the pivot pins 91, 92 and through a center of the pole 97 would point toward the plunger tip 67 with the plunger 63 in the open position.

Return springs 99, 100 are fixedly connected to an interior back portion of the lower housing 85 and disposed below the arms 89, 90. The return springs 99, 100 operate to bias the pushbutton 88 into the default, unactuated position. The return springs 99, 100 additionally provide resistive force against inward movement of the pushbutton 88 such that entry of the pushbutton 88 into the actuated position is conditioned upon the application of an amount of inward force upon the pushbutton 88 that exceeds the amount of resistive force provided by the return springs 99, 100. Although two springs are shown and used in this example, other quantities of springs (e.g., one, three, etc.) may be used.

In the example apparatus illustrated by FIGS. 2 and 3, the actuator 64 is positioned below the valve mechanism 62 such that net attractive force between the magnets 68, 96 with the pushbutton 88 in a default, unactuated position causes the plunger 63 to be positioned in the closed position and net repulsive force between the magnets 68, 96 with the pushbutton 88 in an actuated position causes the plunger 63 to be positioned in the open position. Alternatively, the actuator 64 could be positioned above the valve mechanism 62, in which case the effect of the magnets 68, 96 on the position of the plunger 63 would be reversed. In this case, the polarization of the magnet 96 would be arranged to repel the plunger 63 to bias the plunger 63 into the closed position with the pushbutton 88 in the unactuated position and to attract the plunger 63 to bias the plunger 63 into the open position with the pushbutton 88 in the actuated position. Further, while the example apparatus illustrated by FIGS. 2 and 3 shows that the plunger 63 is positioned in the closed position while the pushbutton 88 is at rest and unactuated and in the open position while the pushbutton 88 is depressed and actuated, these states could be reversed by, e.g., changing the default orientation of one of the magnet 68 or the magnet 96. Additionally, while the actuator 64 is illustrated as including a pushbutton 88, other control devices, such as a slide, a dial, etc., could be used in addition to or in place of the pushbutton 88 without departing from the principles of operation described above. Preferably, the magnets 68, 96 are composed of the same materials and exhibit approximately the same magnetic properties. However, the magnetic properties of the magnets 68, 96 could alternatively vary in relation to each other without departing from the principles of operation discussed above.

According to a preferred embodiment, the apparatus 10 defines at least one sidearm passageway 110. At least one or all of the sidearm passageways 110 are disposed within the body 12 of the apparatus 10 such that the same are fluidly connected to the mixing chamber 40 at generally the median or midsection 46 thereof. Along these lines, and as more clearly illustrated in FIG. 6, sidearm passageways 110 interconnect with the mixing chamber 40 at a point below the ceiling 44 of the mixing chamber. Here, the sidearm passageways 110 are positioned such that they are approximately equidistant from the floor 42 and ceiling 44 of the mixing chamber 40.

Figure 6:
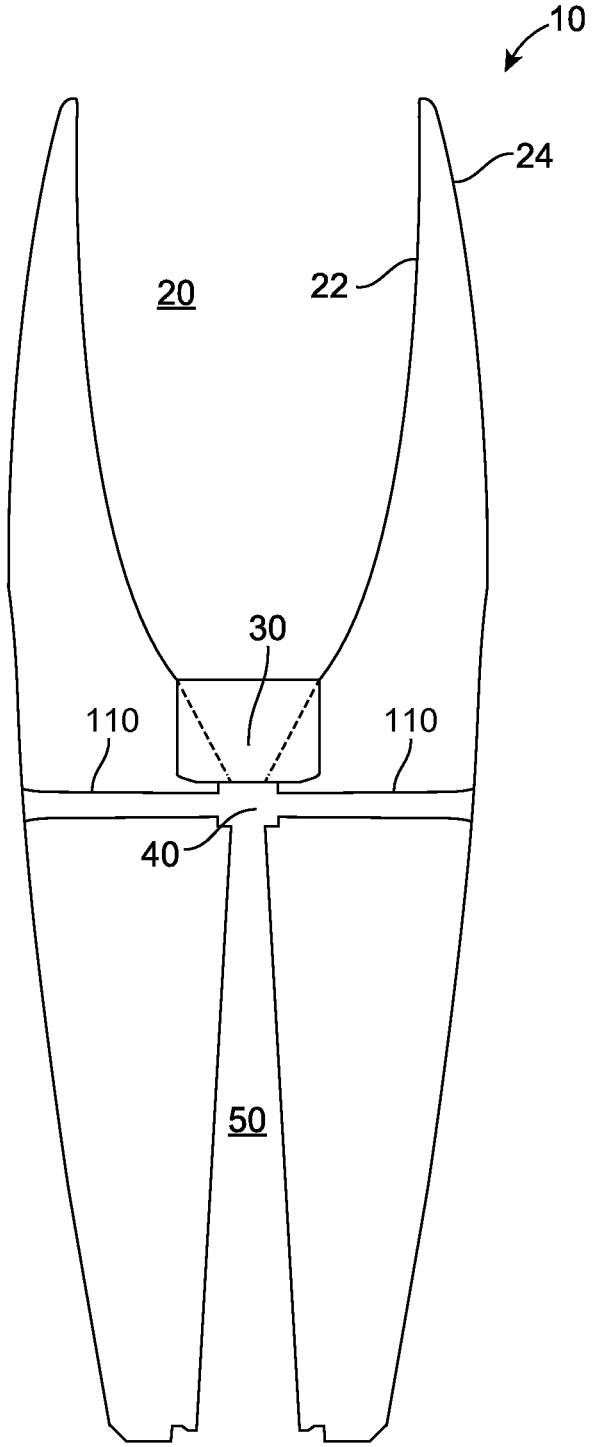
FIG. 6 is a cross-sectional view of sidearm passageways of the apparatus shown in FIG. 1 in a perpendicular configuration.
Figure 7:
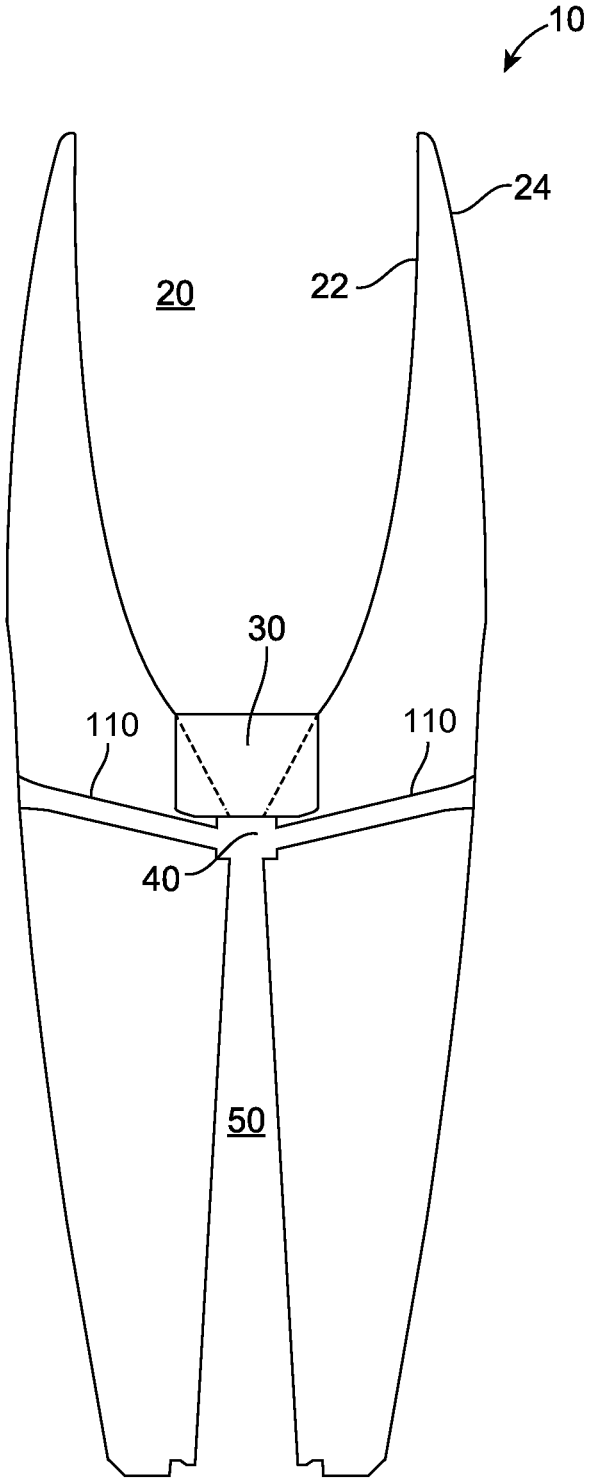
FIG. 7 is a cross-sectional view of sidearm passageways of the apparatus shown in FIG. 1 in a descending configuration.

In the example apparatus shown in FIG. 6, two sidearm passageways 110 are disposed within a body 12 of the apparatus 10. The passageways 110 are disposed in a common plane, i.e., a single imaginary plane can be drawn through both of the passageways 110. Here, with the body 12 being rotationally symmetric, the passageways 110 are diametrically opposed. Each sidearm passageway 110 comprises an outer opening that is open to the atmosphere and enables the entry of atmospheric gases into the apparatus 110 and an inner opening that opens into the mixing chamber 40 and enables mixing of the atmospheric gases within the mixing chamber 40 with at least one other fluid flowing through the apparatus 10. In the example apparatus shown by FIG. 6, the sidearm passageways 110 are positioned at an angle substantially parallel with a bottom edge of the apparatus 10. In an alternative example illustrated by FIG. 7, the sidearm passageways 110 are positioned at an upward angle relative to the bottom edge of the apparatus 10. For instance, the positioning of the sidearm passageways 110 as shown in FIG. 7 could be utilized to inhibit a liquid flowing downwardly through the apparatus 10 from escaping through the sidearm passageways 110, and/or for other purposes. Relative angles at which the sidearm passageways 110 are positioned need not be uniform and could be varied such that, e.g., a first sidearm passageway 110 is positioned as shown in FIG. 6 and a second sidearm passageway 110 is positioned as shown in FIG. 7.

By arranging the interconnection between the sidearm passageways 110 and mixing chamber 40 as shown in FIGS. 6 and 7, the second fluid is thus drawn into and allowed to mix with the first fluid passing into the mixing chamber 40. Here, the mixing chamber 40 has a generally circular cross section and is configured to have a greater diameter relative to the bottom 34 of the transition passageway 30 and the top 52 of the exit chamber 50. This relative diameter, coupled with the introduction of at least one second fluid at substantially the mid portion 46 of the mixing chamber 40, may enable a substantially greater volume of at least one second fluid to be drawn into the fluid flow, which may as a consequence produce a substantially more thorough interaction between the fluids to thus create a resultant mixture having a higher degree of homogeneity when the combined fluids pass through the apparatus 10 relative to the mixing of fluids via conventional Venturi devices.

While FIGS. 6 and 7 illustrate example apparatuses having two sidearm passageways 110 extending horizontally between a mixing chamber 40 and an apparatus body 12, other numbers and/or configurations of the sidearm passageways 110 could be used. For instance, an apparatus can be provided with one sidearm passageway 110, or three or more sidearm passageways. Accordingly, although depicted in FIGS. 6 and 7 as having two diametrically opposed sidearm passageways 110 and associated dedicated openings through which at least one second fluid may be introduced, various design changes and/or modifications of the passageway design may be used.

Figure 8:
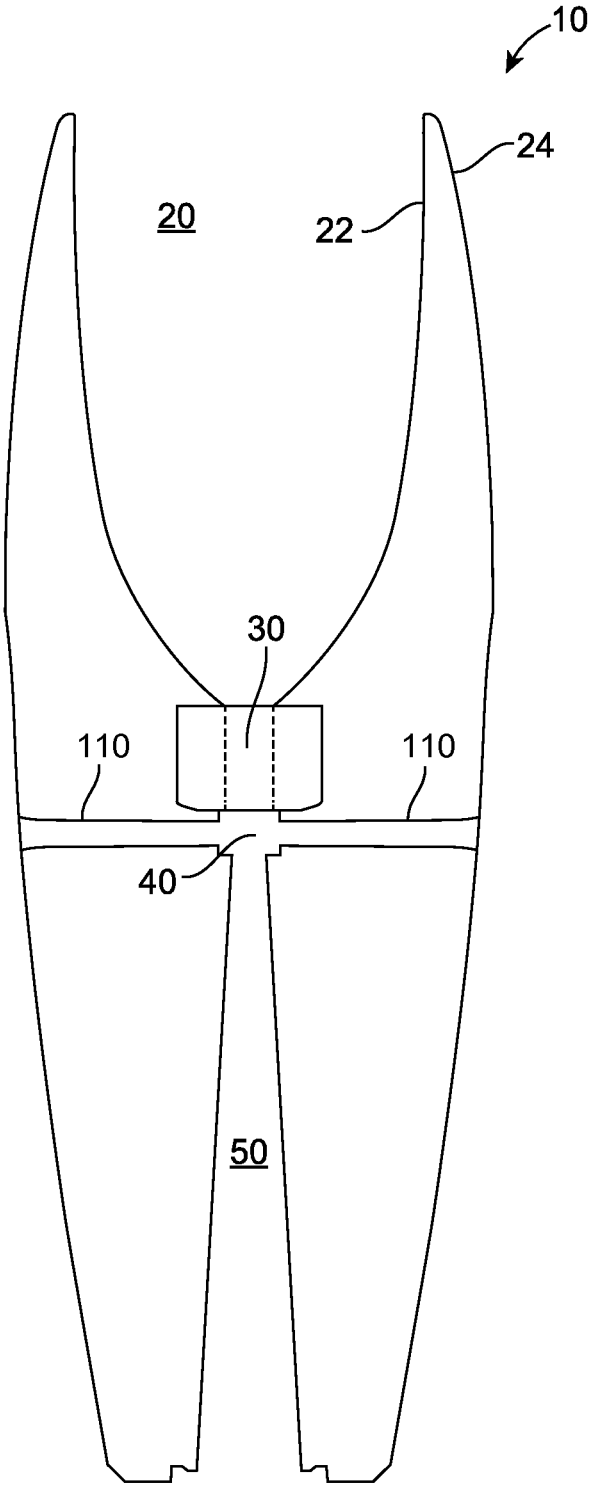
FIG. 8 is a cross-sectional view of a Venturi apparatus comprising a non-tapered funnel-mixing chamber passageway.

The apparatus 10 may be formed as part of a housing, as shown in FIG. 1, or may otherwise be incorporated as part of a fitting or incorporated as part of a tubular pipe structure. The body 12 of the apparatus 10 may be formed as a single structure, or as multiple (e.g., two) structures which are fixedly connected to each other, e.g., via gluing, sonic welding, press fitting, or any other suitable joining technology whereby a fluid- (gas- or liquid-)tight seal is preferably achieved. The various components of the fluid flow regulator 60, including the valve mechanism 62, the actuator 64 and the component parts thereof, can be disposed within the body 12 via gluing, sonic welding, press fitting the component parts into recesses disposed within the body 12 for receiving the component parts, etc., prior to, during or after formation of the body 12. For instance, as shown in FIG. 1, the transition passageway 30 connecting the receptacle chamber 20 and the mixing chamber 40 can be fabricated as an outwardly cylindrical insert into which the first passageway is inlaid, and disposed within the body 12 during assembly of the apparatus 10. With respect to the example apparatus shown in FIG. 1, the transition passageway 30 is a frusto-conical or otherwise tapered passageway. Alternatively, referring to the example apparatus shown in FIG. 8, the transition passageway 30 could be a non-tapered, cylindrical passageway. Other modifications to the transition passageway 30 and/or other sections 20, 40 and 50 of the apparatus 10 are possible.

The apparatus 10 is preferably configured to assume a substantially vertical orientation, to thus enable only gravitational force and atmospheric pressure to cause fluid to flow sequentially through the sections 20, 30, 40 and 50, as shown. The apparatus 10 may, however, be positioned horizontally or at other non-vertical angles and further may be receive fluids that are pressurized.

A variety of dimensions can be utilized in each of the various sections of the apparatus 10. In one specific example, the following dimensions can be utilized: the receptacle chamber 20 has a rounded shape of any length that tapers non-linearly from a top diameter of approximately 39.4 mm to a bottom diameter of approximately 16.4 mm; the transition passageway 30 is a frusto-conical structure having a height of at least 11.3 mm and tapering to a bottom diameter of approximately 4.0 mm; mixing chamber 40 has a diameter of approximately 6.7 mm and a height of approximately 5.1 mm; two symmetrical, diametrically opposed sidearm passageways 110 have lengths of approximately 21.5 mm and diameters of approximately 2.6 mm and fluidly interconnect with the mixing chamber at approximately the mid portion thereof; and the exit chamber 50 is a frusto-conical passageway having a height of approximately 69.9 mm and tapering from a top diameter of approximately 4.0 mm to a bottom diameter of approximately 11.2 mm. Such dimensions, however, are merely one example of dimensions for a Venturi apparatus and other dimensions could be used.

Additionally, the apparatus 10 can be constructed using a variety of materials. Preferably, the apparatus 10 is constructed using non-toxic materials that will not dissolve or mix into fluids, such as wine or spirits, which flow through the apparatus 10. More specifically, materials that can be utilized for construction of the various components of the apparatus 10 are as follows. The body 12 of the apparatus 10, the plunger housing 65 and the upper housing 84 and lower housing 85 of the actuator 64 include acrylate polymers, such as the NAS® 30® acrylic distributed by the PolyOne Corporation of Avon Lake, Ohio, or other plastics. The O-rings 74, 81 can be constructed using silicone or similar materials. The plunger 63, including the magnet housing 66, the cap 72 and the plunger tip 67, as well as the bearings 107, 108 and magnet housing 94 of the actuator 64 can be constructed using polypropylene or other plastics as well stainless steel or other suitable metals. The magnets 68, 96 can be composed of an alloy of neodymium and iron or any other suitable alloy having magnetic properties. Further, the magnets 68, 96 can be nickel plated or coated with another suitable material. The actuator member 68 can be constructed using acrylonitrile butadiene styrene (ABS) polymers or other plastics. Other materials could also be utilized in addition to, or in place of, the materials listed above. Additionally, paints, dyes, pigments or the like could be applied to one or more component parts of the apparatus 10.

The apparatus 10 may be configured to facilitate the mixture of fluids, whether liquid or gas, potable or non-potable. Examples of fluids that preferably can be utilized in association with the apparatus 10 include, but are not limited to, alcoholic beverages such as wine or spirits, nonalcoholic beverages, non-potable liquids such as industrial chemicals, atmospheric or non-atmospheric gases, etc.

Figure 9:
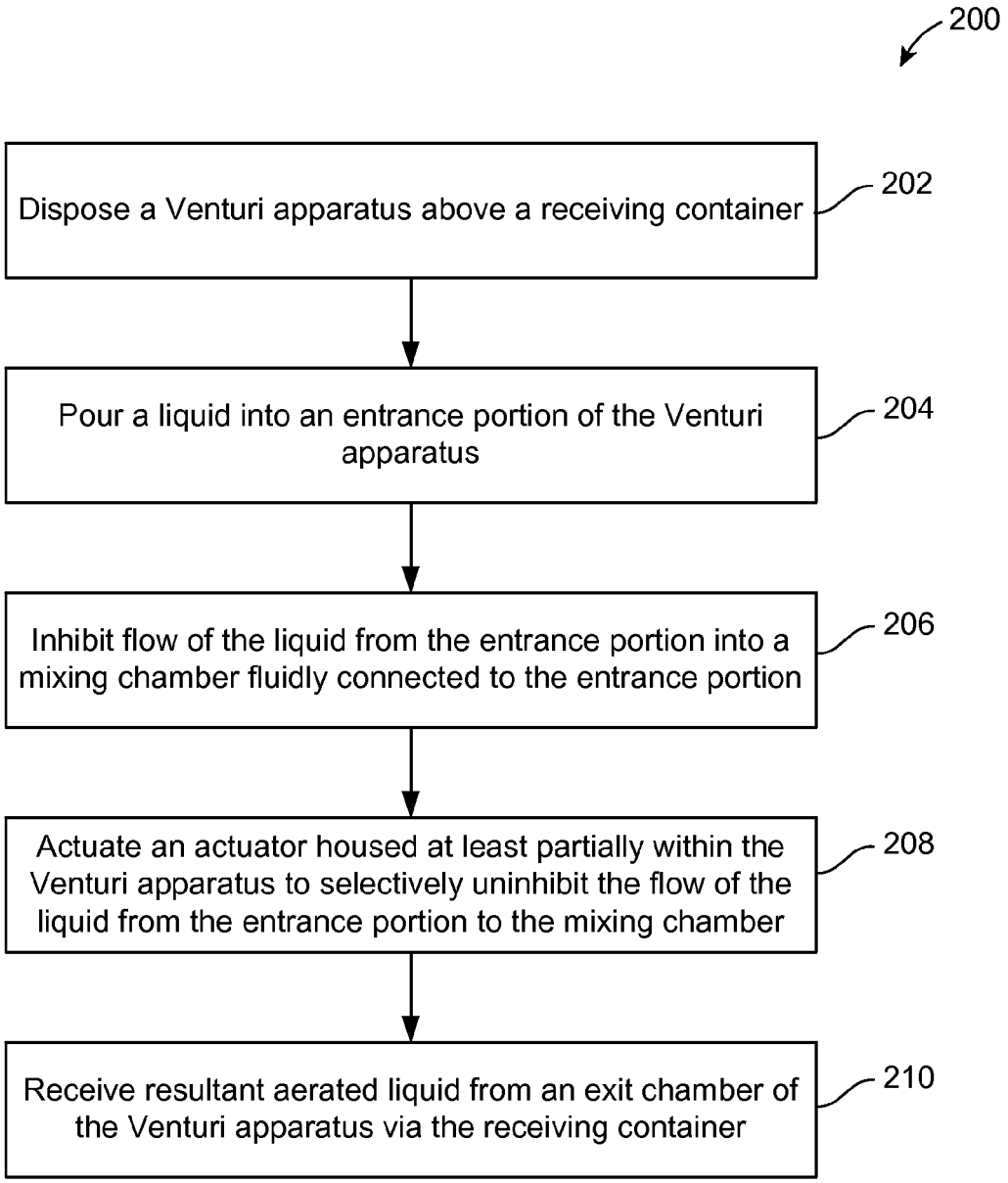
FIG. 9 is a block flow diagram of a process for aerating a liquid.

Referring to FIG. 9, with further reference to FIGS. 1-8, a process 200 of aerating a liquid includes the stages shown. The process 200 is, however, an example only and not limiting. Alterations to the process 200 as shown and described are possible.

At stage 202, the Venturi apparatus 10 is disposed above a receiving container, such as a wine glass or other glass, a carafe, etc. As described above, the Venturi apparatus 10 may be open to the atmosphere, or it may be fluidly connected to a container containing the liquid to be aerated.

At stage 204, a liquid, such as an alcoholic beverage including but not limited to wine or spirits, is poured into the entrance portion 120 of the Venturi apparatus 10. Preferably, the Venturi apparatus 10 is held vertically or near vertically and the liquid is poured downward into the entrance portion 120 of the Venturi apparatus 10 such that flow of the liquid through the Venturi apparatus 10 occurs due to gravitational force and atmospheric pressure without the influence of other outside forces, such as forces resulting from injection of the liquid through the Venturi apparatus 10.

At stage 206, flow of the liquid from the entrance portion 120 into the mixing chamber 40 fluidly connected to the entrance portion 120 is inhibited by the plunger 63 of the valve mechanism. Here, the plunger 63 is received within the body 12 of the Venturi apparatus 10, thereby substantially obstructing the flow of the liquid out of the entrance portion 120 and into the mixing chamber 40.

At stage 208, the actuator 64 housed at least partially within the Venturi apparatus 10 is actuated to selectively permit the flow of the liquid from the entrance portion 120 to the mixing chamber 40. Here, the plunger 63 is magnetically biased away from reception by the entrance portion 120 by the actuator 64, causing the liquid to flow from the entrance portion 120 into the mixing chamber 40. Atmospheric gases are drawn into the Venturi apparatus 10 due to the liquid flowing through the mixing chamber 40 to produce a pressure differential between the mixing chamber 40 and the region external and adjacent to an outer surface of the body 12 (i.e., with the pressure in the mixing chamber 40 being lower than the pressure outside the apparatus 10). The atmospheric gases comingle and mix with the liquid in the mixing chamber 40 to produce a mixture of the liquid and atmospheric gases.

At stage 210, the resultant aerated liquid flows from the Venturi apparatus 10 (e.g., due to gravity) through the exit chamber 50 and is received by the receiving container disposed below the Venturi apparatus 10.

Additional modifications may be made. Thus, the particular combinations of parts and steps described and illustrated herein represent only certain example configurations and/or uses, and do not serve as limitations of alternative devices and methods. Venturi apparatus may be operative to be utilized as stand-alone devices or otherwise incorporated as part of an integrated process and capable of widespread utilization.

What is claimed is:

1. A Venturi apparatus for facilitating the mixture of two or more fluids, the Venturi apparatus comprising:

a body defining:

a receptacle chamber configured to receive a first fluid;

a transition passageway disposed below and in fluid communication with the receptacle chamber and configured to receive the first fluid from the receptacle chamber;

a mixing chamber disposed below and in fluid communication with the transition passageway and configured to receive the first fluid from the transition passageway, wherein a top cross-sectional area of the mixing chamber is greater than a bottom cross-sectional area of the transition passageway; and a sidearm passageway in fluid communication with the mixing chamber and extending to an outer surface of the body, and configured to allow at least a second fluid to pass from an exterior of the body through the sidearm passageway into the mixing chamber; and a fluid flow regulator connected to the body and configured to affect a flow of the first fluid from the receptacle chamber into the mixing chamber, wherein the fluid flow regulator comprises a valve mechanism configured to selectively engage the body to inhibit flow of the first fluid from the receptacle chamber into the mixing chamber;

wherein the valve mechanism comprises a plunger housing fixedly mounted to the body and a plunger slidably coupled with the plunger housing, wherein the plunger housing defines a path of movement of the plunger;

wherein the plunger housing comprises a guide portion and a retainer portion connected to and disposed above the guide portion; and wherein the retainer comprises a plurality of horizontal prongs which extend over the plunger to restrict vertical travel of the plunger as the plunger moves along the path of movement.

2. The Venturi apparatus of claim 1 wherein the receptacle chamber, the transition passageway and the mixing chamber are configured to pass the first fluid therethrough with the receptacle chamber, and the transition passageway and the mixing chamber are disposed in vertical alignment and the first fluid is subjected to gravity.

3. The Venturi apparatus of claim 1 wherein the plunger is positionable within the plunger housing in a closed position, in which the plunger engages at least a portion of a wall of the transition passageway to substantially obstruct fluid flow through the transition passageway and into the mixing chamber, and an open position, in which the plunger is displaced from the wall of the transition passageway to permit flow of the first fluid through the transition passageway and into the mixing chamber.

4. The Venturi apparatus of claim 3 wherein the plunger comprises a plunger tip providing a bottom surface of the plunger and having a shape corresponding to the at least a portion of the wall of the transition passageway and a cross sectional area greater than a cross sectional area of the at least a portion of the transition passageway.

5. The Venturi apparatus of claim 1 wherein the fluid flow regulator comprises a valve mechanism and an actuator that is physically separate from the valve mechanism and is configured to actuate the valve mechanism contactlessly, without direct physical contact between the actuator and the valve mechanism.

6. The Venturi apparatus of claim 1 wherein the sidearm passageway is a first sidearm passageway, the body further defining a second sidearm passageway, the first and second sidearm passageways being disposed within the body aligned along a common plane and fluidly connected to a median of the mixing chamber, wherein each of the plurality of sidearm passageways comprises an outer opening that is open to the atmosphere and permits entry of atmospheric gases and an inner opening that opens into the mixing chamber.

7. The Venturi apparatus of claim 1 wherein the receptacle chamber is open to the atmosphere.

8. The Venturi apparatus of claim 1 wherein the body further defines an exit chamber disposed below and in fluid communication with the mixing chamber and configured to receive a mixture of the first fluid and the second fluid from the mixing chamber, wherein a bottom cross-sectional area of the mixing chamber is greater than a top cross-sectional area of the exit chamber.

9. A Venturi apparatus for facilitating the mixture of two or more fluids, the Venturi apparatus comprising:

a body defining:

a receptacle chamber configured to receive a first fluid;

a transition passageway disposed below and in fluid communication with the receptacle chamber and configured to receive the first fluid from the receptacle chamber;

a mixing chamber disposed below and in fluid communication with the transition passageway and configured to receive the first fluid from the transition passageway, wherein a top cross-sectional area of the mixing chamber is greater than a bottom cross-sectional area of the transition passageway; and a sidearm passageway in fluid communication with the mixing chamber and extending to an outer surface of the body, and configured to allow at least a second fluid to pass from an exterior of the body through the sidearm passageway into the mixing chamber; and a fluid flow regulator connected to the body and configured to affect a flow of the first fluid from the receptacle chamber into the mixing chamber, wherein the fluid flow regulator comprises a valve mechanism configured to selectively engage the body to inhibit flow of the first fluid from the receptacle chamber into the mixing chamber;

wherein the valve mechanism comprises a plunger housing fixedly mounted to the body and a plunger slidably coupled with the plunger housing, wherein the plunger housing defines a path of movement of the plunger;

wherein the fluid flow regulator further comprises an actuator that is physically separated from the plunger and is configured to actuate the plunger to slide relative to the plunger housing;

wherein:

the plunger comprises a first magnet; and the actuator comprises a second magnet rotatably coupled to the body.

10. The Venturi apparatus of claim 9 wherein the actuator further comprises an actuator member movably coupled to the body and configured to cause, when moved relative to the body, the second magnet to rotate from a first orientation biasing the plunger into a closed position to a second orientation biasing the plunger into an open position.

11. The Venturi apparatus of claim 10 wherein: the actuator further comprises an actuator housing and a magnet housing containing the second magnet;

the actuator member is movably coupled to the actuator housing and comprises a plurality of arms disposed along a bottom portion of the actuator member and slidably coupled to an interior of the actuator housing;

the actuator member is positionable relative to the actuator housing in an actuated position and an unactuated position; and the magnet housing is pivotably coupled to the actuator housing by a plurality of pivot pins extending from opposing sides of the magnet housing.

12. The Venturi apparatus of claim 11 wherein:

each of the plurality of pivot pins includes cogs having first teeth disposed along at least a portion of the circumference of the pin; and each of the plurality of arms comprises second teeth that are sized, shaped and disposed corresponding to the first teeth such that the first teeth mesh with the second teeth.

13. The Venturi apparatus of claim 12 wherein the second teeth of the arms are configured to interact with the first teeth of the pivot pins to rotate the pivot pins when the actuator member moves between the unactuated position and the actuated position, thereby rotating the second magnet between the first orientation when the actuator member is in the unactuated position and the second orientation when the actuator member is in the actuated position.

14. The Venturi apparatus of claim 13 wherein in the first orientation, the second magnet has a first pole closer to the plunger than a second pole, and in the second orientation has the second pole closer to the plunger than the first pole, the first pole having a magnetic polarity opposite to a magnetic polarity of a bottom pole of the first magnet.

15. The Venturi apparatus of claim 13 wherein the first teeth and second teeth are configured and the actuator member has sufficient travel relative to the pivot pins such that movement of the actuator member causes rotation of the second magnet between the first orientation and the second orientation.

16. The Venturi apparatus of claim 13 wherein the actuator further comprises a return spring configured and disposed to bias the actuator member into the unactuated position.

17. A Venturi apparatus for facilitating the mixture of a liquid with a gas, the Venturi apparatus comprising:

a body defining:

a receptacle chamber configured to receive the liquid;

a mixing chamber disposed below and in fluid communication with the receptacle chamber and configured to receive the liquid; and a sidearm passageway in fluid communication with the mixing chamber and extending to an outer surface of the body, and configured to allow the gas to pass from an exterior of the body adjacent to the outer surface into the mixing chamber; and flow regulating means for selectively inhibiting flow of the liquid from the receptacle chamber to the mixing chamber and for selectively permitting flow of the liquid from the receptacle chamber to the mixing chamber, the flow regulating means comprising valve means and actuating means for actuating the valve means, without physical contact with the valve means, to selectively inhibit or selectively permit flow of the liquid from the receptacle chamber to the mixing chamber;

wherein the actuating means comprises a first magnet coupled to the valve means and a second magnet coupled to an actuating member movably coupled to the body.

* * * * *